US005255447A

United States Patent [19]

Christ

[11] Patent Number: 5,255,447

[45] Date of Patent: Oct. 26, 1993

[54] HEAT PROTECTION HOOD

[75] Inventor: Alfred Christ, Zürich, Switzerland

[73] Assignee: Sulzer-Escher Wyss GmbH, Ravensburg, Fed. Rep. of Germany

[21] Appl. No.: 840,769

[22] Filed: Feb. 24, 1992

[30] Foreign Application Priority Data

Feb. 26, 1991 [DE] Fed. Rep. of Germany ..... 4105978

[51] Int. Cl.[5] ..... D06F 58/00

[52] U.S. Cl. ..... 34/114; 34/119; 34/122

[58] Field of Search ..... 34/114, 119, 122, 123, 34/23, 115-117, 124

[56] References Cited

U.S. PATENT DOCUMENTS

| | | | |
|---|---|---|---|
| 2,499,141 | 2/1950 | Helmus | 34/114 |
| 2,939,222 | 6/1960 | Svavar | 34/18 |
| 3,052,991 | 9/1962 | Goldner | 34/89 |
| 3,163,502 | 12/1964 | Justus et al. | 34/114 |
| 3,206,869 | 9/1965 | Justus | 34/114 |
| 3,318,017 | 5/1967 | Smith, Jr. | 34/114 |
| 4,462,868 | 7/1984 | Oubridge et al. | 34/114 |
| 4,523,390 | 6/1985 | McCarthy | 34/115 |

FOREIGN PATENT DOCUMENTS

| | | |
|---|---|---|
| 919229 | 10/1954 | Fed. Rep. of Germany . |
| 261636 | 5/1949 | Switzerland . |
| 285914 | 5/1929 | United Kingdom . |

*Primary Examiner*—Henry A. Bennett
*Assistant Examiner*—Denise L. Gromada
*Attorney, Agent, or Firm*—Townsend and Townsend Khourie and Crew

[57] ABSTRACT

Heat protection hood for heated rolls (1) in particular for rapidly running rolls (1) in paper machines which are partly surrounded by the heat protection hood. In this arrangement an outer screen (7) is arranged partly around the roll (1) and is concentric to it. The outer screen (7) and a likewise concentrically extending partition screen (4) present between it and the roll (1) form an inner gap (5) and an outer gap (6). Respective deflection zones (9) for the air flow drawn along by the roll (1) in the inner gap (5) adjoin each of the ends of the partition screen (4). Deflecting units (10, 11) are provided there so as to deflect the recirculating air flow around the ends of the partition screen (4). The invention is intended to substantially reduce heat losses through radiation and convection and offers the possibility of influencing the axial temperature profile of the roll (1).

23 Claims, 1 Drawing Sheet

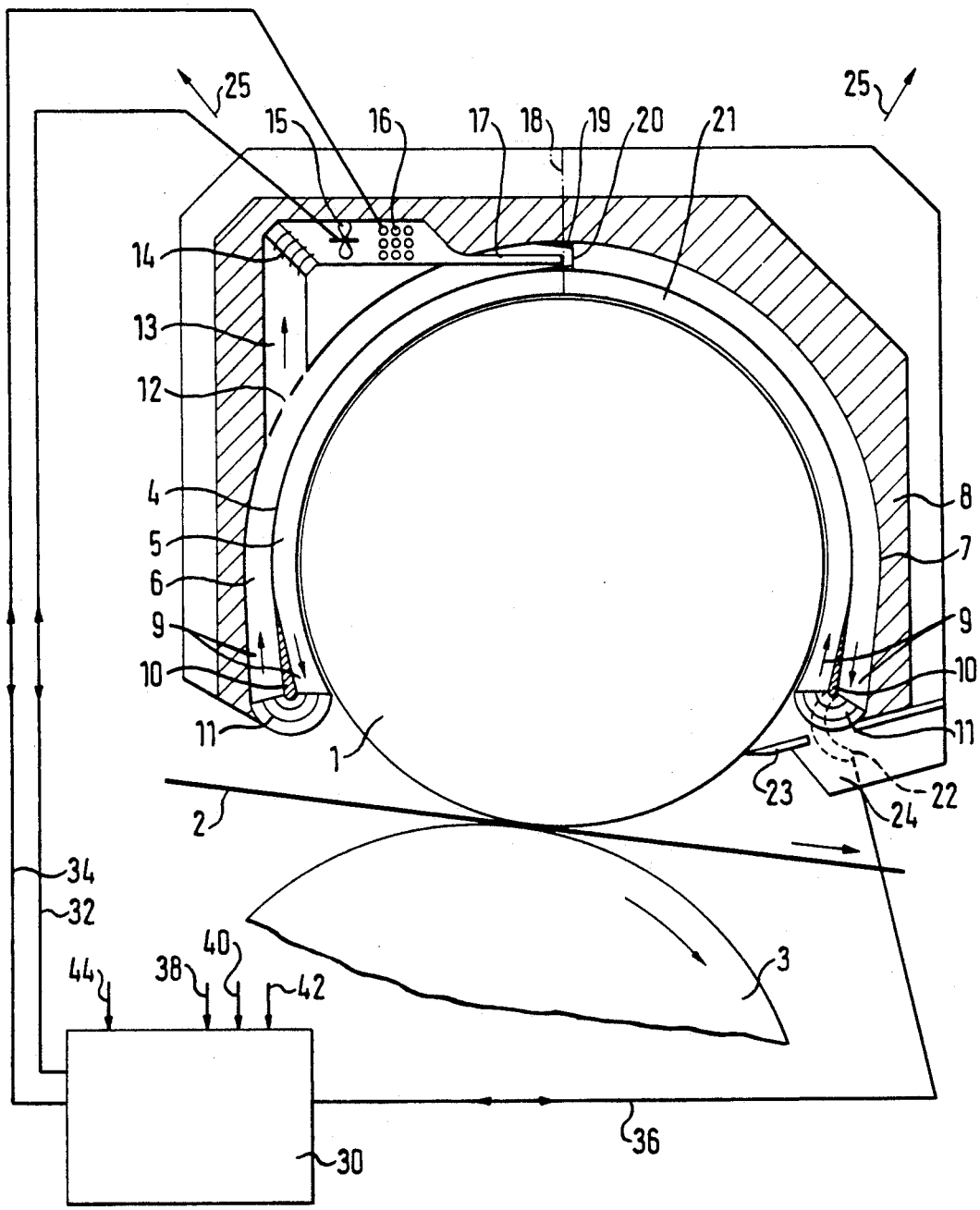
25
25
15
16
17
18
19
20
21
14
13
12
4
5
6
9
10
11
8
7
9
10
11
1
2
23
22
24
34
32
44
38
40
42
3
30
36

HEAT PROTECTION HOOD

BACKGROUND OF THE INVENTION

The invention relates to a heat protection hood for heated rolls, in particular rapidly running rolls in paper machines.

For increasing the smoothness of paper it is often necessary to use heated rolls in the smoothing or glazing mechanism. The surface temperatures of over 200° C. which are sometimes necessary result in correspondingly high heat losses through convection and radiation.

It is possible to substantially reduce the radiation losses through the use of known protective hoods with thermal isolation. However, the convection which then predominates as a result of the rolls being made to rotate ever more rapidly cannot be effectively countered. Environmental air is sucked in at one side of the protective hood is drawn along by the roll and is blown out again at the other side in the heated state.

Allround sealing also does not lead to any significant improvement as a result of the surface wear and also the pressure conditions which thereby build up. In addition to this comes the fact that the heat loss promoted by the pressure differences over the end faces of the roll lead to a non-uniform temperature profile along the length of the roll.

SUMMARY OF THE INVENTION

The present invention is based on the object of providing a heat protection hood for rapidly running heated rolls which substantially reduces the heat losses through convection and radiation and additionally offers the possibility of influencing the axial temperature profile of the roll.

In accordance with the invention this object is satisfied by a heat protection hood for heated rolls, in particular fast running rolls in paper machines which are partly surrounded by the hood, characterized in that an outer screen is arranged partially surrounding the roll and extends concentrically to it, with the outer screen forming, together with a likewise concentrically extending partition screen disposed between it and the roll, an inner gap and an outer gap. The deflection zones for the air drawn along by the roll in the inner gap adjoins the ends of the partition screen, with inbuilt deflector units attached there directing the air flow from the one gap into the respective other gap.

The resulting forced circulation of the air which is drawn along by the roll within the heat protection hood, which is naturally thermally insulated, substantially reduces the losses through radiation and convection.

Nevertheless, the pressure difference which thereby arises between the deflection regions ensures that at these regions a small amount of air is blown out or sucked in. To take account of this the outer gap should be broader than the inner gap (radially broader) and should in each case increase towards the ends of the gaps in order to reduce the speed in the deflection regions. Full pressure compensation can for example be achieved if a part flow is branched off from the outer gap, is accelerated via a fan and is supplied again to the outer gap.

It is furthermore of advantage to subdivide the roll into a plurality of axial zones via at least one partition web which extends in the radial direction close up to the roll surface and which also increases the static strength of the heat protection hood. The zonewise control of the temperature and thus also of the thickness profile of the roll can be made possible in this arrangement by providing a branch duct zonewise in the course of the outer gap. This branch duct supplies a part of the air flow via fans, via a controllable heating unit and also via an injector which opens into the outer gap. It is also of advantage if control flaps for cooling are present zonewise in the deflection region at the paper outlet side, with these control flaps permitting the admission of environmental air into the inner gap and simultaneously permitting the discharge of hot air to the environment out of the outer gap.

In addition, a holder for a scraper, which may eventually be necessary, can be integrated into the heat protection hood. It is also of benefit, above all for heat protection hoods which surround more than half the roll, to make the heat protection hood in two parts. The partition joint between the two halves should then preferably be located in the region of the opening of the injector, since the narrowing of the cross-section which is necessary for the provision of joint sealing surfaces lying transverse to the flow has little effect at this position.

The invention will be explained in further detail in the following with reference to an embodiment. In the accompanying drawing the figure shows a cross-section through the heat protection hood.

A heated roll 1 and a counter roll 3 jointly form the smoothing or glazing mechanism for the paper web 2. Approximately two thirds of the roll I are surrounded by an outer screen or shield 7 which extends concentrically to it. The outer screen or shield 7 together with a partition screen 4, which is present between it and the roll 1 and which likewise extends concentrically to the roll 1, jointly form an inner gap 5 and an outer gap 6. The outer gap 6 is thereby approximately twice as wide as the inner gap 5 with the widths of the gaps 5 and 6 respectively increasing towards their ends, i.e. their ends adjacent the circumferential ends of the partition screen lying parallel to the axis of the roll. These ends of the partition screen 4 are adjoined by respective deflection regions 9 for the air drawn along by the roll 1 in the inner gap 5. The inbuilt deflecting units 10 and 11 which are mounted there have rounded contours and direct the air flow into the respective other one of the gaps 5 and 6. That is to say the air moving out of the inner gap 5 at the left hand side of the drawing is turned so that it can move back along the outer gap 6, while air moving through the outer gap 6 at the right hand side of the drawing is turned so that it can move in the direction of the arrow shown there along the inner gap 5 under the influence of the roll 1 which rotates in the same direction as that arrow, i.e. in the opposite direction to the arrow shown on the roll 3.

In order to influence the temperature profile the roll i is subdivided into several axial zones by several separating webs 21 which extend in the radial direction close up to the roll 1. The webs 21 extend radially across both the outer gap 6 and the inner gap 5. In the zones formed between adjacent webs, or between the web or webs and side plates at the axial ends of the rolls, there is in each case provided a branch 12 and a branch duct 13 in the course of the outer gap 6. Each branch duct 13 supplies a part of the air stream via deflection blades 14 and a fan means 15 to a controllable heating unit 16 and also to an injector 17 which again opens into the outer gap 6 of the respective zone. Furthermore, a respective rotatable control flap 22 is provided in each zone in the deflection zone 9 at the paper outlet side. The control flaps 22 make it possible to suck in colder air and also to blow out warm air. The outer shield 7 and also the branch duct or ducts 13 are surrounded by a thermally insulating layer 8.

In the vicinity of the control flap 22 there is provided a scraper 23. The scraper carrier 24 has the form of a rail and forms a unit with the heat protection hood. The partition joint 18 of the thermal protection hood is located in the region of the opening of the injector 17. This permits the two parts to be moved apart in the radial directions 25 by means of non-illustrated guide rails and hydraulic cylinders for the purpose of repair and cleaning. Wedge-like built in units 19 present at the partition joint 18 form sealing surfaces for the resilient sealing elements 20 which lie transverse to the flow.

The reference numeral 30 schematically represents a microprocessor controlled regulating system which is connected by respective lines 32, 34 and 36 to the fan means 15, the heating means 16 and the controllable flap means 22 for each zone of the roll 1.

The reference numerals 38, 40 and 42 indicate lines which supply temperature signals to the microprocessor 30, e.g. for the surface temperature of the roll in each zone and/or for the air temperature in the inner and/or outer gaps 5, 6. The corresponding temperature signals can be taken into account by the microprocessor in determining the control signals for the fan means 15, the heating means 16 and the controllable flap means 32. Further inputs can also be provided, such as 44, for other relevant parameters, such as the speed of rotation of the roll, and indeed this speed of rotation can also be controlled by the microprocessor. It is particularly preferred when a microprocessor present for controlling the operation of the smoothing mechanism is also used for the control purposes discussed above.

The reference numerals used in the claims are purely intended by way of explanation and are not intended to restrict the scope of the claims in any way.

I claim:

1. Heat protection hood for a heated roll comprising: an outer screen arranged partially surrounding the roll and extending concentrically to the roll, the outer screen forming, together with a likewise concentrically extending partition screen disposed between the outer screen and the roll, an inner gap and an outer gap; and in that respective deflection zones for air drawn along by the roll in the inner gap adjoin the ends of the partition screen with inbuilt deflector units which are attached directing the air flow into the respective other gap; and a branch, having a branch duct, provided zonewise in the course of the outer gap configured to supply a part of the air via deflection vanes and fans to a controllable heating unit and also to an injector which opens into the outer gap again; and control flaps arranged zonewise in the deflection zone at an outlet side, and make is possible to admit environmental air into the inner gap and to simultaneously discharge hot air from the outer gap to the environment.

2. Heat protection hood in accordance with claim 1, wherein the control flaps and the heating unit are connected to means for controlling the temperature profile of the roll zonewise.

3. Heat protection hood for a heated roll comprising: an outer screen partially surrounding the roll and extending concentrically to the roll, the outer screen forming, together with a likewise concentrically extending partition screen disposed between the outer screen and the roll, an inner gap and an outer gap; and in that respective deflection zones for air drawn along by the roll in the inner gap adjoin the ends of the partition screen with inbuilt deflector units which are attached directing the air flow into the respective other gap the heat protection hood being of two part construction and a partition joint being location in a region of an opening of an air injector.

4. Heat protection hood for reducing radiative and convective heat losses from a rotatably mounted heated roll having a direction of rotation, said hood partly surrounding said roll and comprising an outer screen disposed substantially concentric to and spaced apart from said heated roll, a partition screen disposed between said outer screen and said heated roll substantially concentric to said heated roll, said partition screen being radially spaced from said heated roll and from said outer screen to form an inner gap between said partition screen and said heated roll and an outer gap between said partition screen and said outer screen, said rotatably mounted heated roll drawing a flow of air through said inner gap, with said flow of air through said inner gap substantially only being directed in said direction of rotation of said heated roll, said partition screen terminating circumferentially at an upstream end and a downstream end, said upstream and downstream ends being defined by the direction of flow in said inner gap, and means promoting recirculating of said flow of air drawn along by said heated roll through said inner gap around the downstream end of said partition screen and back through said outer gap to the upstream end of said partition screen for renewed recirculation at least in part, around said upstream end of said partition screen and back through said inner gap.

5. Heat protection hood in accordance with claim 4 wherein said means promoting a recirculating flow of air comprises deflecting means provided at said upstream and downstream ends of said partition screen respectively.

6. Heat protection hood in accordance with claim 4 wherein at least one radially extending partition wall is provided and extends through said inner and outer gaps from said outer screen up to the surface of said heated roll, said at least one partition wall dividing said inner and outer gaps into respective axial zones along said heated roll.

7. Heat protection hood in accordance with claim 6 wherein means is provided for promoting the recirculation of air through said inner and outer gaps in each of said axial zones.

8. Heat protection hood in accordance with claim 7 wherein said promoting means comprises means for injecting a fluid into the outer gaps of said axial zones in the direction of said recirculating air flow.

9. Heat protection hood in accordance with claim 8 wherein said fluid comprises fluid drawn from said recirculating air flow via branch duct means.

10. Heat protection hood in accordance with claim 9 wherein fan means is provided for accelerating said fluid drawn from said recirculating air flow.

11. Heat protection hood in accordance with claim 7 further comprising means for heating and cooling said fluid.

12. Heat protection hood in accordance with claim 6 wherein controllable flap means is provided in each said axial zone for controlling at least one of the admission of external air to said axial zone and the discharge of heated air from said axial zone.

13. Heat protection hood in accordance with claim 6 further comprising a branch, having a branch duct, provided zonewise in the course of the outer gap and being configured to supply a part of the air via deflection vanes and fans.

14. Heat protection hood in accordance with claim 13 wherein the branch is coupled to an injector which opens into the outer gap.

15. Heat protection hood in accordance with claim 13 further comprising a controllable heating unit fluidly coupled to the branch.

16. Heat protection hood in accordance with claim 4 wherein said outer gap is larger in a radial direction than said inner gap.

17. Heat protection hood in accordance with claim 16, wherein the outer gap is approximately twice as broad as the inner gap.

18. Heat protection hood in accordance with claim 4, wherein the heat protection hood surrounds approximately one half to two thirds of a periphery of the roll.

19. Heat protection hood in accordance with claim 4 wherein thermal insulation is provided at an outer side of said outer screen.

20. Heat protection hood in accordance with claim 4 wherein said inner and outer gaps each diverse at each of said upstream and downstream ends of said partition screen.

21. Heat protection hood in accordance with claim 4 further comprising first and second separable halves and means for sealingly joining said halves together at a partition joint.

22. Heat protection hood for reducing radiative and convective heat losses from a rotatably mounted heated roll having a direction of rotation and adapted for the treatment of a material web, said material web contacting said heated roll at a first location, said hood partly surrounding said roll at a second location separate from said first location and comprising an outer screen disposed substantially concentric to and spaced apart from said heated roll, a partition screen disposed between said outer screen and said heated roll substantially concentric to said heated roll, said partition screen being radially spaced from said heated roll and from said outer screen to form an inner gap between said partition screen and said heated roll and an outer gap between said partition screen and said outer screen, and means promoting a recirculating flow of air drawn along by said heated roll through said inner gap in said direction of rotation around a downstream end of said partition screen and back through said outer gap to an upstream end of said partition screen for renewed recirculation at least in part, around said upstream end of said partition screen and through said inner and outer gaps.

23. Heat protection hood in combination with a heated roll having a direction of rotation, said heated roll being adapted for the treatment of a material web which contacts said heated roll at a first location and said heat protection hood being adapted to reduce radiative and convective heat losses from said heated roll and partly surrounding said heated roll at a second location separate from said first location, said heat protection hood comprising an outer screen disposed substantially concentric to and spaced apart from said heated roll, a partition screen disposed between said outer screen and said heated roll substantially concentric to said heated roll, said partition screen being radially spaced from said heated roll and from said outer screen to form an inner gap between said partition screen and said heated roll and an outer gap between said partition screen and said outer screen, and means promoting a recirculating flow of air drawn along by said heated roll through said inner gap in said direction of rotation around a downstream end of said partition screen and back through said outer gap to an upstream end of said partition screen for renewed recirculation at least in part, around said upstream end of said partition screen and through said inner and outer gaps.

* * * * *